US006857165B2

(12) United States Patent
Oh

(10) Patent No.: US 6,857,165 B2
(45) Date of Patent: Feb. 22, 2005

(54) GRILL ASSEMBLY FOR A CYCLONE-TYPE DUST COLLECTING APPARATUS FOR A VACUUM CLEANER

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 393 days.

(21) Appl. No.: 10/156,457

(22) Filed: May 28, 2002

(65) Prior Publication Data

US 2003/0159239 A1 Aug. 28, 2003

(30) Foreign Application Priority Data

Feb. 27, 2002 (KR) ..... 2002-10628

(51) Int. Cl.[7] ..... A47L 9/16

(52) U.S. Cl. ..... 15/353; 55/DIG. 3; 55/410; 55/459.4

(58) Field of Search ..... 15/327.1, 327.2, 15/327.6, 327.7, 347, 350–353; 55/337, 429, 459.1, 459.4, 482, 486, DIG. 3

(56) References Cited

U.S. PATENT DOCUMENTS

| | | | | |
|---|---|---|---|---|
| 5,908,493 | A | 6/1999 | Krymsky | |
| 6,195,835 | B1 | 3/2001 | Song et al. | |
| 6,269,518 | B1 | 8/2001 | Yung | |
| 6,391,101 | B2 * | 5/2002 | Gustafson et al. | 96/333 |
| 6,757,933 | B2 * | 7/2004 | Oh et al. | 15/353 |
| 2001/0049928 | A1 * | 12/2001 | Park et al. | 55/400 |
| 2004/0154126 | A1 * | 8/2004 | Hansen et al. | 15/353 |

FOREIGN PATENT DOCUMENTS

| | | |
|---|---|---|
| CN | 1319372 | 10/2001 |
| EP | 0972573 | 7/1998 |
| EP | 0972573 | 1/2000 |
| JP | 11290724 | 10/1999 |
| RU | 2050940 | 12/1995 |
| SE | 508515 | 10/1998 |
| WO | WO00/64321 | 11/2000 |

OTHER PUBLICATIONS

British Examination Report—Issue date: Nov. 8, 2002.

* cited by examiner

*Primary Examiner*—Terrence R. Till
(74) *Attorney, Agent, or Firm*—Ladas & Parry LLP

(57) ABSTRACT

A grill assembly for a cyclone-type dust collecting apparatus reduces the amount of contaminants passing through a grill, and also allows easy removal of contaminants from the grill, includes a grill body having a plurality of blades formed along an outer circumference of the grill body spaced at predetermined intervals from one another to define passages interconnected with the air outlet; and a fine contaminant blocking member mounted within the grill body, a first body portion, and a second body portion on which the plurality of blades are arranged, the second body portion being removably connected to the first body portion, so that reverse passage of contaminants through the passage of the grill body is inhibited accordingly, the amount of contaminants entering into the cleaner body can be reduced.

5 Claims, 5 Drawing Sheets

GRILL ASSEMBLY FOR A CYCLONE-TYPE DUST COLLECTING APPARATUS FOR A VACUUM CLEANER

CLAIM OF PRIORITY

This application hereby refers to, and incorporates herein by reference, an earlier filed patent application entitled GRILL ASSEMBLY FOR A CYCLONE-TYPE DUST COLLECTING APPARATUS FOR A VACUUM CLEANER, filed in the Korean Industrial Property Office on Feb. 27, 2002, and there duly assigned Serial Number 2002-10628. Applicant hereby claims all benefits accruing under 35 U.S.C. Section 119 for and from said earlier filed Korean patent application.

BACKGROUND OF THE INVENTION

1. Field of the Invention

The present invention relates to a cyclone-type dust collecting apparatus for a vacuum cleaner, and more particularly, to a grill assembly of a cyclone-type dust collecting apparatus for a vacuum cleaner for separating dust or filth from the air whirling in the cyclone-type dust collecting apparatus.

2. Description of the Prior Art

A cyclone-type dust collecting apparatus separates particles from a fluid by using a centrifugal force. Due to its simple structure and high resistance to high temperature and high pressure, the cyclone-type dust collecting apparatus has been used in many industrial fields and even in vacuum cleaners.

The vacuum cleaner having the cyclone-type dust collecting apparatus is constructed such that relatively large particles of contaminants are firstly filtered in the cyclone-type dust collecting apparatus before contaminant-laden air flows to a paper filter of the cleaner body. Since the amount of contaminants that have to be filtered at the paper filter is decreased by the cyclone apparatus, the life span of the paper filter is lengthened. Also, problems like suction force deterioration and motor overload, which are caused by a clogged or obstructed paper filter, can also be prevented.

U.S. Pat. No. 6,195,835 (application Ser. No. 09/388,532) issued Mar. 6, 2001 to the same applicant disclosed a vacuum cleaner having the above-described cyclone-type dust collecting apparatus.

FIG. 1 is a sectional view schematically showing the structure and operation of the cyclone dust collecting apparatus for a vacuum cleaner as disclosed in U.S. Pat. No. 6,195,835.

As shown in FIG. 1 of the present application, the cyclone-type dust collecting apparatus 10 disclosed in U.S. Pat. No. 6,195,835 is disposed on extension pipes 1*a* and 1*b* of the vacuum cleaner.

By using the centrifugal force of the whirling air, the cyclone-type dust collecting apparatus 10 separates and collects dust and filth from contaminant-laden air that is drawn in through a suction port of the cleaner. The cyclone-type dust collecting apparatus 10 includes a cyclone body 20, a dust receptacle 30 and a grill assembly 40.

The cyclone body 20 has a first connection pipe 21 connected to the extension pipe 1*a* at the suction port of the cleaner, a second connection pipe 22 connected to the extension pipe 1*b* at a body of the cleaner, an air inlet 23 interconnected with the first connection pipe 21 and an air outlet 24 interconnected with the second connection pipe 22. The contaminant-laden air is drawn into the cyclone body 20 through the air inlet 23, forming a vortex of air.

The dust receptacle 30 is removably connected to the cyclone body 20, and collects the contaminants that are separated from the air by the centrifugal force of the vortex of air generated in the cyclone body 20.

The grill assembly 40 is disposed on the lower side of the air outlet 24 of the cyclone body 20 to prevent contaminants collected in the dust receptacle 30 from entering into the cleaner body. The grill assembly 40 has a grill supporting portion 41, a conical grill portion 42 and a cylindrical grill portion 43, which are integrally formed with each other. The cylindrical grill portion 43 has a plurality of fine holes 43*a* interconnected with the air outlet 24. The cylindrical grill portion 43 has a conical dust blocking plate 44 formed on a distal end.

In the vacuum cleaner having the cyclone-type dust collecting apparatus as described above, contaminant-laden air is drawn into the vacuum cleaner along the pipe 1*a* by the suction force that is generated at the suction port of the cleaner, and the air flows into the cyclone body 20 through the first connection pipe 21 in a diagonal or downwardly helical flow and direction. The air is diagonally drawn into the cyclone body 20 into a whirling helical current that moves downward to the bottom of the dust receptacle 30. During this process, contaminants are separated from the air by the centrifugal force of the whirling air current, and are collected in the dust receptacle 30 after falling along an inner wall of the dust receptacle 30. The air reaching the bottom of the dust receptacle 30 turns in direction and moves upward in a smaller radius helical flow, and flows outside of the cleaner body through the fine holes 43*a* of the grill assembly 40, the air outlet 24 and the second connection pipe 23. While the air flows outside, along the outside of the grill assembly 40, some of the contaminants entrained in the air are trapped by the fine holes 43*a* of the grill assembly 40, and fall into the dust receptacle 30.

Contaminants which are not separated by the centrifugal force of the whirling air and thus are still entrained in the air are discharged to the air outlet 24 through the fine holes 43*a* of the grill assembly 40, but are filtered at a paper filter in the cleaner body and the cleaned air is discharged out of the cleaner by the motor and vacuum-inducing blower (not shown).

In a vacuum cleaner having the cyclone-type dust collecting apparatus described above, dust and filth entrained in the air drawn into the suction port of the cleaner are firstly filtered and collected by the cyclone-type dust collecting apparatus, and as a result, the amount of contaminants that the paper filter has to filter decreases.

The conventional cyclone-type dust collecting apparatus for a vacuum cleaner described above, however, has some problems. That is, as shown in FIG. 2, the plurality of fine holes 43*a* of the grill assembly 40 are formed at an angle approximately of 90° with respect to a stream line B of the whirling air in the cyclone-type dust collecting apparatus, and the contaminants entrained in the whirling air are easily drawn into the cleaner body through the fine holes 43*a* in the direction indicated by dotted arrows of FIG. 2. Since the conventional cyclone-type dust collecting apparatus for vacuum cleaner does not have any means to filter fine contaminants that are more minute than the fine holes 43*a*, most of fine contaminants are drawn into the cleaner body through the fine holes 43*a* and, accordingly, the contaminants being filtered at the paper filter increase. As a result, the lifespan of the paper filter is shortened.

Another problem of the conventional vacuum cleaner cyclone-type dust collecting apparatus is that some contaminants are not discharged but instead adhere to the fine holes 43*a* of the grill assembly 40 as the air flows through the fine holes 43*a*. As time goes by, the contaminants clog the fine holes 43*a*, causing problems like suction force deterioration and motor overload. Accordingly, the contaminants at the fine holes 43*a* have to be removed regularly. However, the structural characteristic of the grill assembly makes it hard for a user to clean the grill, causing inconvenience to the user.

SUMMARY OF THE INVENTION

The present invention has been made to overcome these problems of the prior art. Accordingly, it is an object of the present invention to provide a grill assembly for a cyclone-type dust collecting apparatus for a vacuum cleaner capable of extending the effective life span of a paper filter by reducing an amount of contaminants drawn into a body of the vacuum cleaner through a grill by using a fine-contaminant filter means that filters fine contaminants, and also by not allowing the contaminants entrained in a whirling air to pass through the grill.

Another object of the present invention is to provide a grill assembly for a cyclone-type dust collecting apparatus for a vacuum cleaner in which removal of contaminants attached to a grill is easy so that a user can use the vacuum cleaner more conveniently.

The above object are accomplished by a grill assembly for a cyclone-type dust collecting apparatus for a vacuum cleaner according to the present invention, including a grill body having an open upper end; a plurality of blades formed along an outer circumference of the grill body at predetermined intervals from one another to define passages interconnected with the air outlet; and a fine contaminant blocking member mounted within the grill body at a position corresponding to the passages in the grill body to filter out fine contaminants that pass through the passage.

The grill body includes a first body portion being supported on the air outlet of the cyclone body and having a through hole, and a second body portion on which the plurality of blades are arranged, the second body portion being removably connected to the first body portion by connecting means.

The connecting means includes a pair of connecting grooves formed in an inner circumference of the through hole of the first body portion, the groove being located substantially opposite to each other, each of the connecting grooves having a positioning portion having an open lower end and a connecting portion extending from the positioning portion and having a closed lower end; and a pair of connecting protrusions formed on an upper end of the second body portion to be substantially opposite to each other, the pair of connecting protrusions corresponding to the pair of connecting grooves, respectively.

Preferably the blades are arranged such that an extended line from a center of the blade is at an acute angle with respect to a stream line of the whirling air.

It is also preferred that the interval between the blades and the angle between the blade and the stream line of the whirling air is set at a range in which a shadow of a particular blade overlaps 10~50% of a shadow of the next blade, when the blades are projected onto an imaginary coaxial cylinder.

Preferably, the fine contaminant blocking member is formed of a porous material.

BRIEF DESCRIPTION OF THE DRAWINGS

The above-mentioned objects and the feature of the present invention will be more apparent by describing the preferred embodiment of the present invention in detail and by referring to the appended drawings, in which.

DETAILED DESCRIPTION OF PREFERRED EMBODIMENTS

Figure 1:
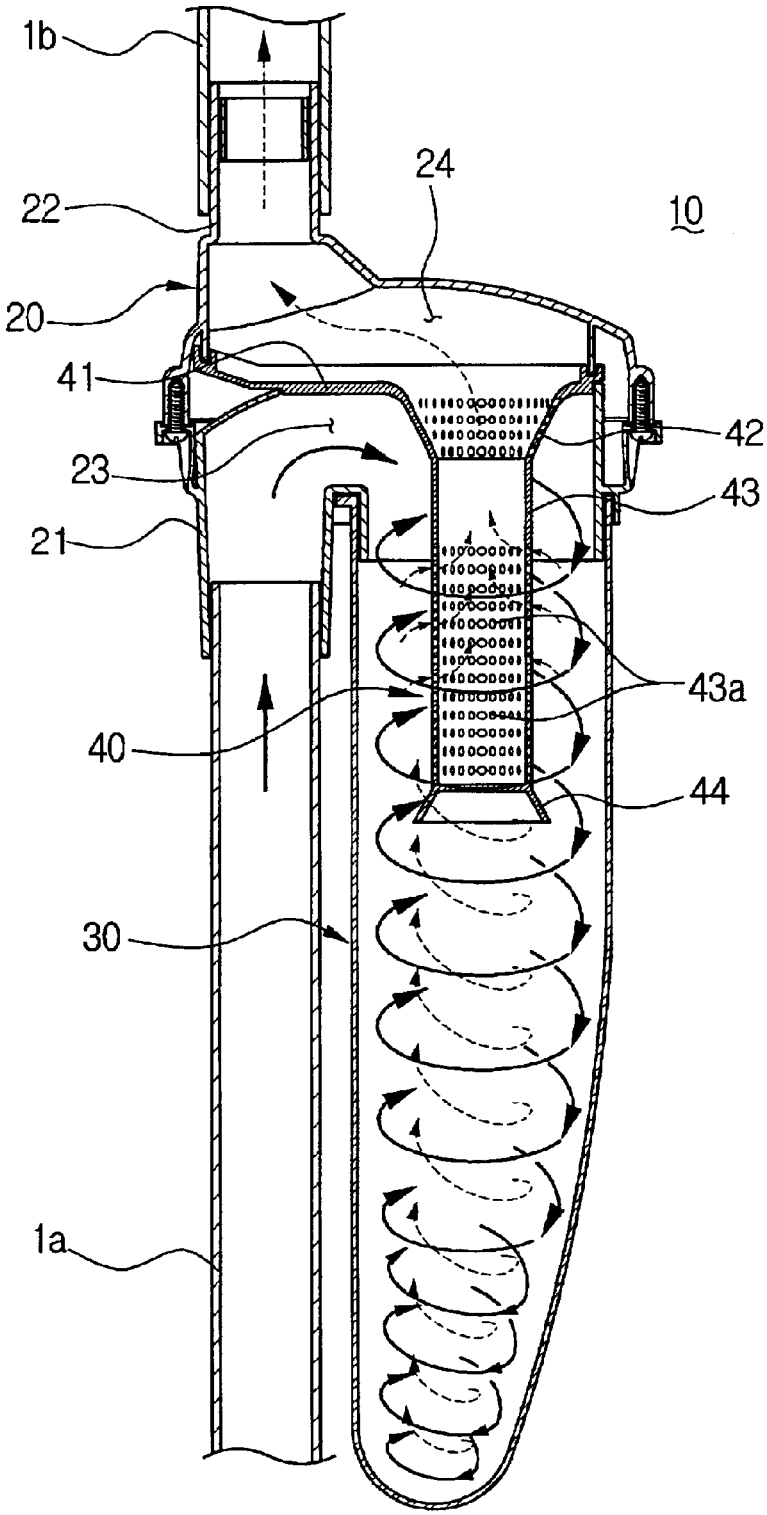
FIG. 1 (PRIOR ART)
FIG. 1 is a sectional view of a conventional cyclone-type dust collecting apparatus for a vacuum cleaner.
Figure 2:
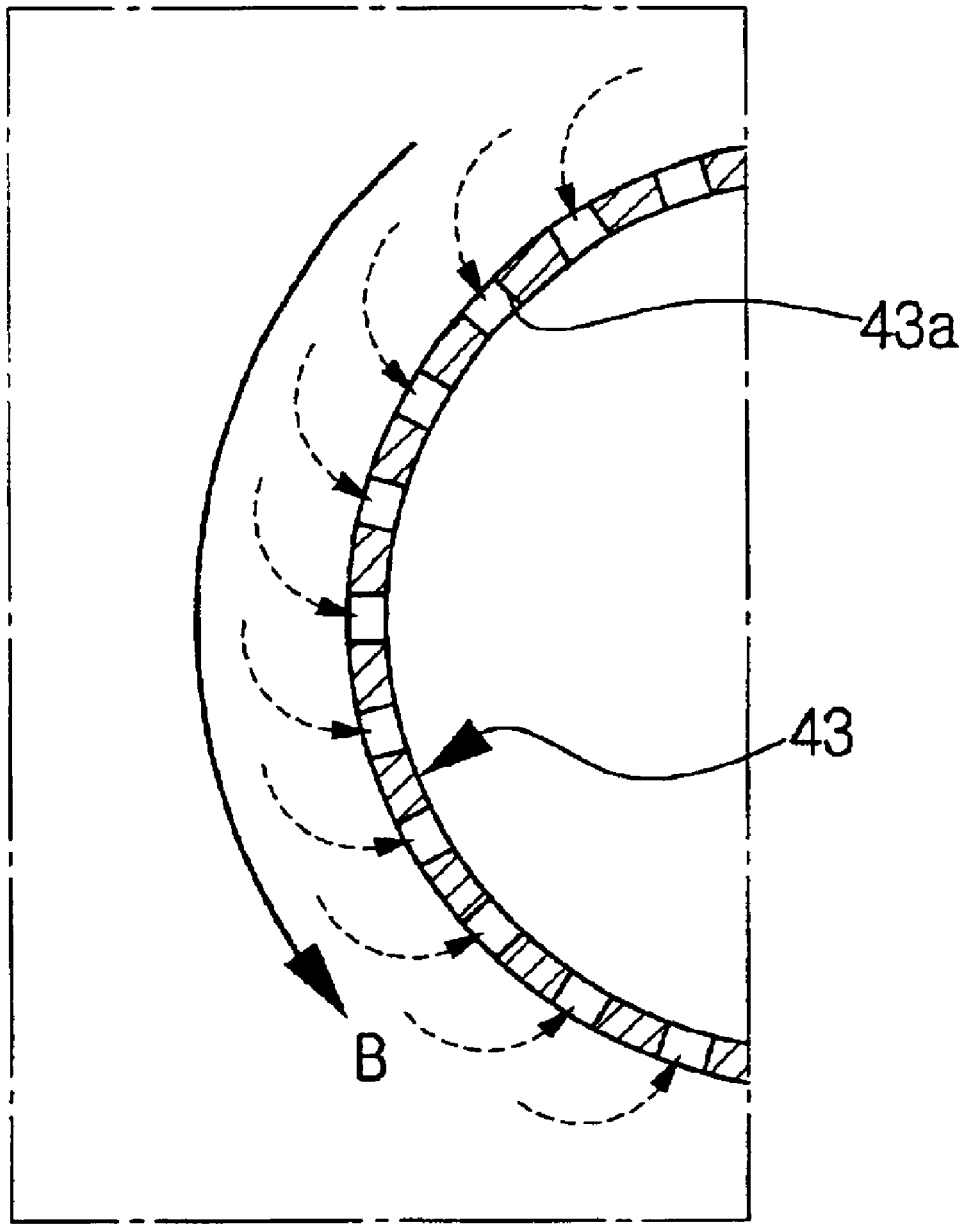
FIG.2 (PRIOR ART)
FIG. 2 is a partial sectional view suggesting the direction of a flow of air around a grill of the conventional cyclone-type dust collecting apparatus for the vacuum cleaner.

The preferred embodiment of the present invention will be described in greater detail with reference to the accompanying drawings. Throughout the description, the like elements of the cyclone-type dust collecting apparatus will be given the same reference numerals of the prior art, except for a grill assembly.

Figure 3:
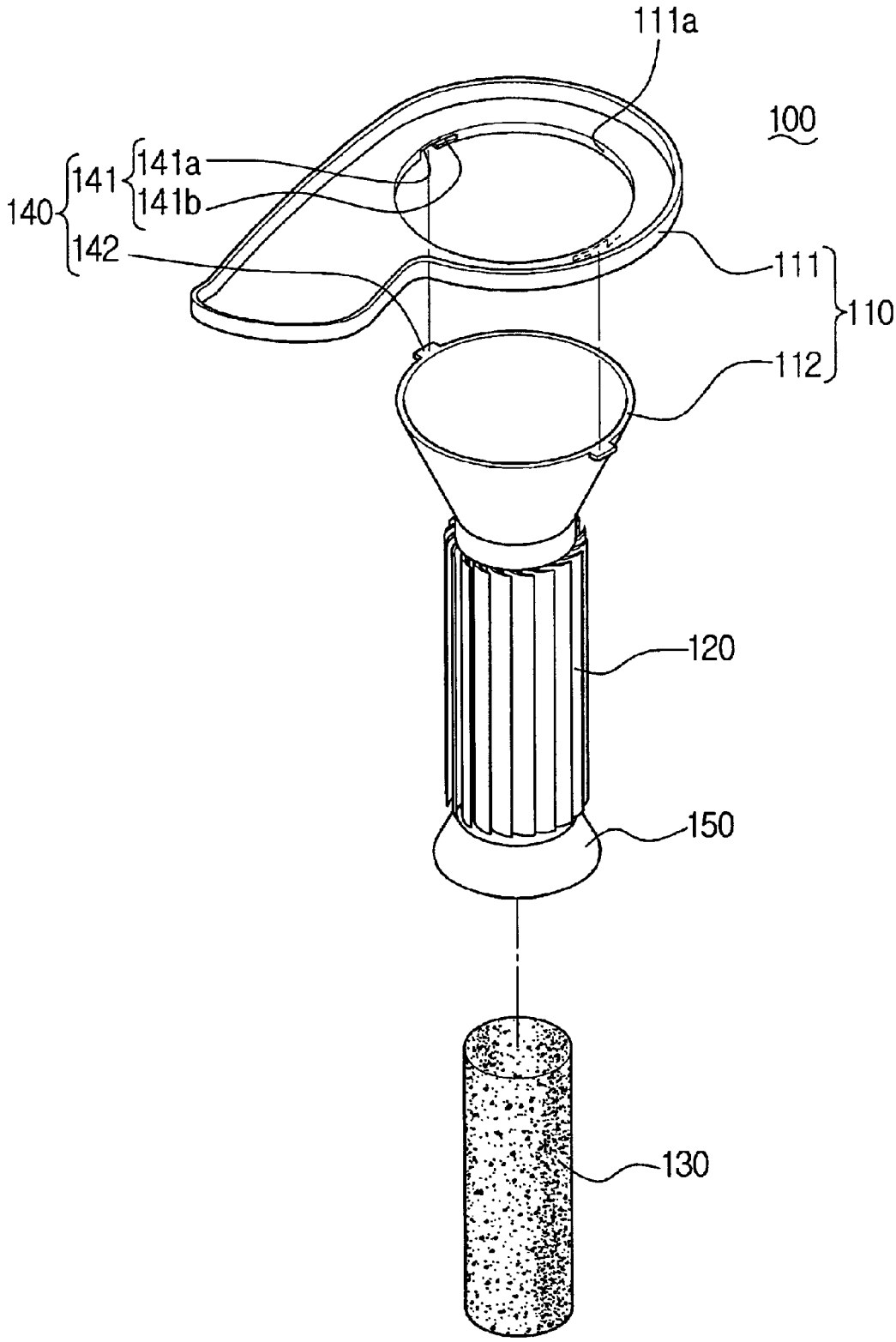
FIG. 3 is an exploded view of a grill assembly for a cyclone-type dust collecting apparatus for a vacuum cleaner according to the preferred embodiment of the present invention.
Figure 4:
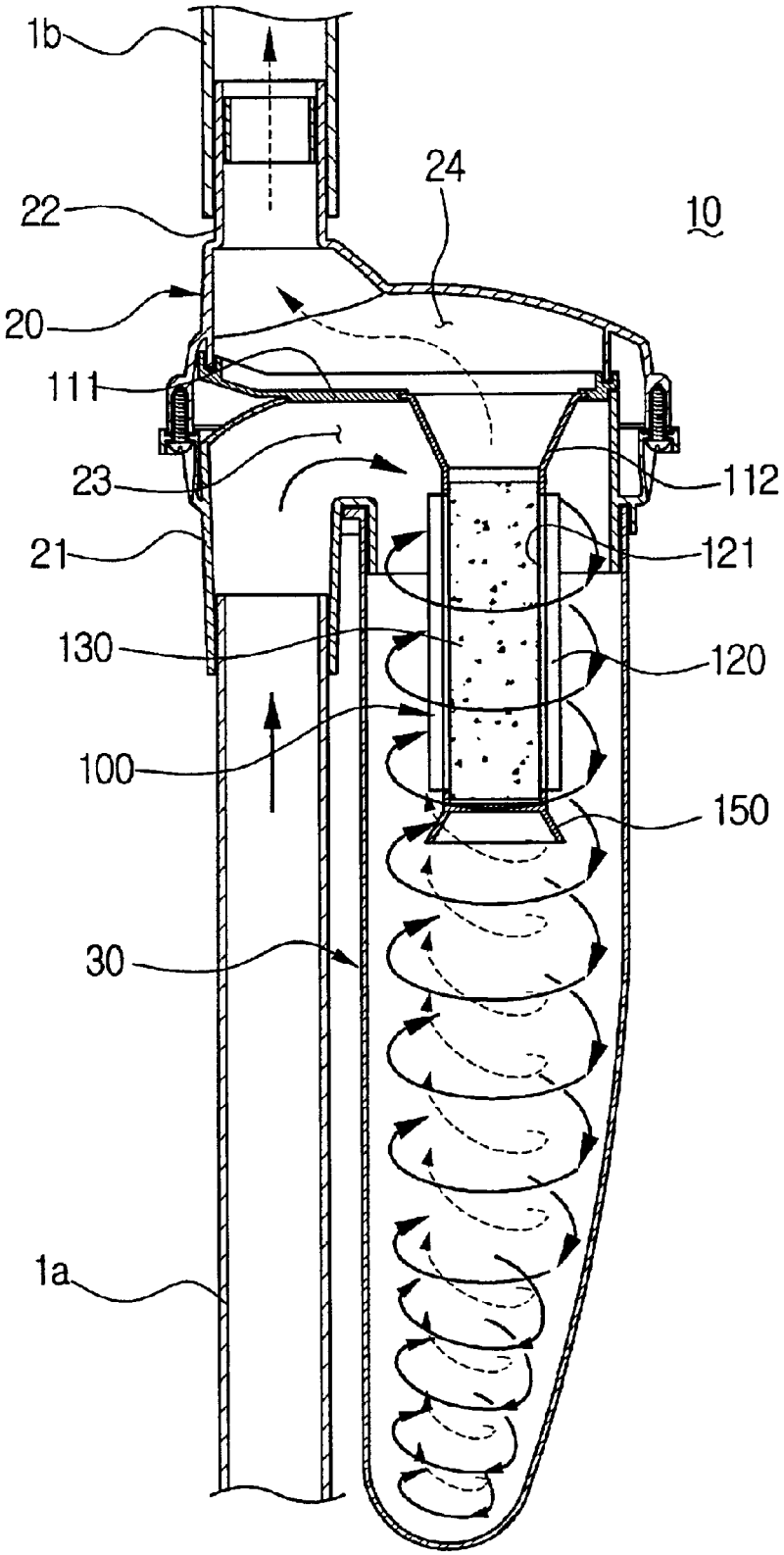
FIG. 4 is a sectional view showing the grill assembly according to the preferred embodiment of the present invention being employed in a body of the cyclone-type dust collecting apparatus.
Figure 5:
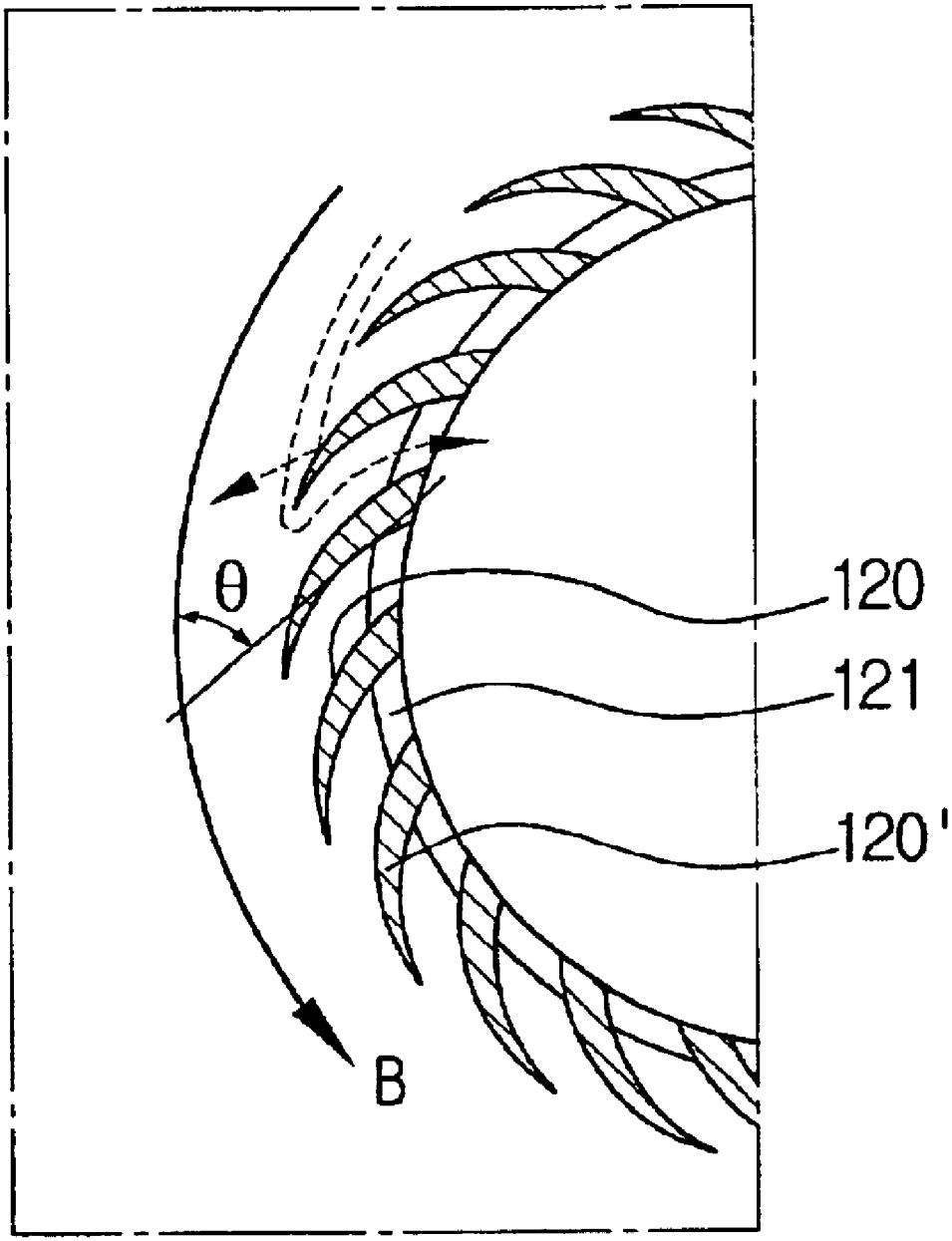
FIG. 5 is a partial sectional view suggesting the direction of the flow of air around the grill assembly for the cyclone-type dust collecting apparatus for the vacuum cleaner according to the preferred embodiment of the present invention.

As shown in FIGS. 3 through 5, a grill assembly 100 for a cyclone-type dust collecting apparatus for a vacuum cleaner according to the preferred embodiment of the present invention includes a grill body 110 having an upper open end interconnected with the air outlet 24 formed in the cyclone body 20, a plurality of blades 120 formed on an outer circumference of the grill body 110 at a predetermined interval to define a passage 121 along the outer circumference of the grill body 110 interconnected with the air outlet 24, and a fine contaminant blocking member 130 mounted within the grill body 110 at a position corresponding to the passage of the grill body 110 to filter the fine contaminants that pass through the passage.

As shown in FIG. 3, the grill body 110 includes a first body portion 111 having a through hole 111*a*, and a second body portion 112 on which the plurality of blades 120 are arranged. The second body portion 112 is removably connected to the first body portion 111 by a connecting unit 140. The connecting unit 140 has a pair of connecting grooves 141 formed in the inner circumference of the through hole 111*a* of the first body portion 111 and are located substantially opposite to each other. A pair of mating or connecting protrusions 142 are formed on an upper end of the second body portion 112 to be substantially opposite to each other. Each connecting groove 141 has a positioning portion 141*a* having an open lower end, and a connecting portion 141*b* extending from the positioning portion 141*a* and having a closed lower end. Accordingly, a user connects the second body portion 112 to the first body portion 111 by aligning and inserting the connecting protrusions 142 of the second body portion 112 into the positioning grooves 141*a* of the connecting grooves 141 of the first body portion 111, and twisting the second body portion 112 thereby positioning the connecting protrusions 142 at the connecting portions 141*b* of the connecting grooves 141. The user separates the second body portion 112 from the first body portion 111 by reversing this process. Accordingly, when contaminants are attached to the grill body 110, the user can remove the contaminants from the respective blades 120 of the second body portion 1112 with ease since he/she is simply required to separate the second body portion 112 from the first body portion 111 to clean the blades 120. A dust reversal preventing plate 150 (FIG. 3) can be provided.

The plurality of blades 120 are arranged along the outer circumference of the grill body 110, or along the outer circumference of the second body portion 112 to be exact, at a predetermined interval from one another in a manner of permitting air to flow therethrough. That is, a passage 121 is defined among the blades 120 as shown in FIG. 4.

As shown in FIG. 5, the blades 120 are arranged such that the angle θ between the center line of each blade 120 and the stream line B of the whirling air is at an acute angle. In other words, the passage 121 is at the acute angle with respect to the stream line B of the whirling air, and the particulate contaminants are inhibited from entering the passage 121 of the grill while borne by the whirling air.

More specifically, as suggested by the dotted arrows of FIG. 5, the particulate contaminants in the whirling air have to turn in their direction about more than 90° in order to enter into the passage 121 between the blades 120. In other words, the contaminants have to reverse their direction of travel to enter into the passage 121, which is almost impossible. As a result, the contaminants are inhibited from entering the passage 121.

The entrance of contaminants into the passage 121 can be prevented more effectively by decreasing the angle θ, i.e., the interval of the respective blades 120 (or passage 121) as narrower as possible. This will, however, also increase a flow resistance of the air passing through the passage 121. Also, the noise will be worsened and the cleaning efficiency of the vacuum cleaner may also drop due to the suction force deterioration. Therefore, the angle θ and the interval between the blades 120 have to be set at an appropriate degree in consideration of the above-mentioned situations.

Preferably, the angle θ and the interval between the blades 120 is set within the range in which a shadow of one blade 120 overlaps from about 10% to about 50% of the shadow of the next blade 120', when the blades 120 are projected on an imaginary coaxial cylinder.

The fine contaminant blocking member 130 is mounted within the second body portion 112 of the grill body 110, to filter out the fine contaminants that pass through the passage 121. Preferably, the fine contaminant blocking member 130 is made of a porous material that has an excellent air permeability such as a sponge, etc. In another example, the fine contaminant blocking member 130 can be a cylindrical net that has a mesh structure.

As shown in FIG. 4, the grill assembly 100 is formed downward from the air outlet 24 of the cyclone body 20 as the first body portion 111 is supported on the air outlet 24. The fine contaminant blocking member 130 is mounted within the second body portion 112 of the grill body 110.

As the vacuum cleaner operates, the whirling air current is generated within the cyclone body 20. Accordingly, the contaminants are separated from the contaminant-laden air by the centrifugal force of the whirling air, and are collected into the dust receptacle 30.

Some contaminants which are not separated in the centrifuging step, i.e., the contaminants that are not separated by the centrifugal force of the whirling air, are suspended in the air that moves around the center portion of the dust receptacle 30 upwardly toward the grill assembly 100. At least some of these contaminants entrained in the upwardly moving air are reflected by the dust reversal reflector plate 150, and are returned to the whirling air current. Contaminants which still remain in the air after encountering the dust reversal reflector plate 150, are moved toward the passage 121 of the grill assembly 100 by the air flow. Due to different pressures in and outside of the grill assembly 100, the air is drawn into the grill assembly 100 through the passage 121. Meanwhile, as described above, the passage 121, defined by the plurality of blades 120, is formed and located so that it is positioned at an acute angle with respect to the stream line B of the whirling air. Also, the contaminants have relatively greater density than the air, and thus the contaminants have a greater inertia than the air.

In order for the contaminants entrained in the whirling air to enter into the passage 121 between the blades 120, this contaminant particle inertia must be overcome, and the direction of the whirling air current must be turned more than 90°. In other words, the contaminants are inhibited from entering into the passage 121 between the blades 120. Accordingly, the amount of contaminants moving toward the cleaner body is decreased.

If some fine contaminants which are more minute than the passage 121, enter into the passage 121, they are trapped by the fine contaminant blocking filter member 130 according to the present invention. As a result, the amount of the contaminants that move toward the cleaner body is decreased, and the lifespan of the paper filter is lengthened.

Meanwhile, whenever the vacuum cleaner operates, some contaminants inevitably adhere to the blades 120 of the grill body 110. When the blades 120 become visibly dirty, the user simply separates the second body portion 112 from the first body portion 111, and cleans the blades 120.

As described above, according to the present invention, since the entrance of the contaminants through the passage 121 of the grill body 110 is prevented as much as possible, the amount of contaminants reaching the cleaner body is decreased. Also, since even the fine contaminants, which are smaller than the passage 121, are filtered at the fine contaminant blocking member 130, the amount of contaminants to the cleaner body is once again reduced. As a result, the lifespan of the paper filter is lengthened.

Also, according to the present invention, the grill body 110 is separable into the first body portion 111 and the second body portion 112. Accordingly, the user can easily clean the grill body 110 when the need arises, after simply separating the second body portion 112 from the first body portion 111. As a result, the vacuum cleaner becomes easy to use.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. A grill assembly for a cyclone-type dust collecting apparatus for a vacuum cleaner, the cyclone-type dust collecting apparatus operating to separate contaminants from a whirling flow of air by the centrifugal force of contaminant-laden air in the grill assembly being formed on an air outlet of a cyclone body of the cyclone-type dust collecting apparatus to prevent entrance of contaminants to a body of the vacuum cleaner, the grill assembly comprising:

a grill body having an open upper end and including a first body portion being supported on the air outlet of the cyclone body and having a through hole and a second body portion on which the plurality of blades are arranged, the second body portion being removably connected to the first body portion by a connection means;

a plurality of blades formed along an outer circumference of the grill body spaced at predetermined intervals from one another to define passages interconnected with the air outlet; and a fine contaminant blocking member mounted within the grill body and in communication with passage of the grill body to filter out fine contaminants that pass through the passage.

2. The grill assembly of claim 1, wherein the connecting means further comprises:

a pair of connecting grooves formed in an inner circumference of the through hole of the first body portion, the grooves being located substantially opposite to each other, each of the connecting grooves having a positioning portion having an open lower end and a connecting portion extending from the positioning portion and having a closed lower end; and a pair of connecting protrusions formed on an upper end of the second body portion, the grooves being located substantially opposite to each other, the pair of connecting protrusions corresponding to the pair of connecting grooves, respectively.

3. The grill assembly of claim 1, wherein each of the blades is arranged such that an extended line from a center of the blade defines at an acute angle with respect to a stream line of the whirling air.

4. The grill assembly of claim 3, wherein the interval between the blades and the angle between the blade and the stream line of the whirling air is set at a range in which a shadow of a particular blade overlaps from about 10% to about 50% of a shadow of the next blade, when the blades are projected onto an imaginary coaxial cylinder.

5. The grill assembly of claim 1, wherein the fine contaminant blocking member is formed of a porous material.

* * * * *